US006217121B1

(12) United States Patent
Mollet

(10) Patent No.: US 6,217,121 B1
(45) Date of Patent: Apr. 17, 2001

(54) THERAPEUTIC CUSHIONING DEVICE

(76) Inventor: Jan Mollet, P.O. Box 1894, Canal St. Station, New York, NY (US) 10013

( * ) Notice: Subject to any disclaimer, the term of this patent is extended or adjusted under 35 U.S.C. 154(b) by 0 days.

(21) Appl. No.: 09/336,136

(22) Filed: Jun. 18, 1999

(51) Int. Cl.[7] ..... A47C 7/02

(52) U.S. Cl. ..... 297/452.28; 297/452.21; 297/452.29; 601/97

(58) Field of Search ..... 297/452.28, 180.11, 297/180.12, 452.21, 452.29; 601/97, 100, 134, 136, 122

(56) References Cited

U.S. PATENT DOCUMENTS 3,081,129 * 3/1963 Ridder ..... 297/452.28 X
4,367,897 * 1/1983 Cousins ..... 297/452.28
4,413,857 * 11/1983 Hayashi ..... 297/180.11

FOREIGN PATENT DOCUMENTS

280792 * 9/1970 (RU) ..... 297/452.28

* cited by examiner

*Primary Examiner*—Anthony D. Barfield

(57) ABSTRACT

A therapeutic cushion device used in combination with an article of furniture to achieve comfort for a user comprises a seat portion, which comprises a plurality of vertically moving pins in substantially close proximity to one another. Each pin comprises a spherical member at a top portion thereof, the spherical members functioning to receive the weight of the user and further functioning to adapt to the contour of the user's body. Vertical movement of the pins and spherical members are accomplished through the usage of a spring means. This allows the device to provide constant stimulation to the body, functioning to facilitate blood circulation of the user by providing multiple pressure points upon the user by means of full body to surface contact. In the preferred mode, the spherical members are manufactured of a wood material and the pins are manufactured of a stainless steel material. In all instances, a varying quantity of pins of varying lengths may be utilized to adequately conform to the contour of users of all sizes.

5 Claims, 3 Drawing Sheets

THERAPEUTIC CUSHIONING DEVICE

BACKGROUND OF THE INVENTION

1. Field of the Invention

The present invention is a cushioning system for chairs, automobile seats, beds and the like that features a multiple pin and spring assembly for the utmost in user comfort. Specifically, the cushioning apparatus includes a great number of vertically moving pins, preferably with spherical shaped members at a top portion thereof, that receive the weight of the user and function to fit the contour of the user's body. In the preferred mode, wood spherical embers upon stainless steel pins are in close proximity to one another, to engage all relevant pressure points of the body and allow the user to remain on the furniture item for extended periods without discomfort. Based on the particular needs of users, the device may include a varying quantity of pins, a varying length of pins utilized, and varying materials of construction. The device may also be designed in an aesthetically pleasing manner, with pins and spherical heads colored in such a fashion as to create desired images upon the furniture item. In all such cases, the device allows for the frame of the furniture item to be simpler in nature and easier to manufacture, as the pins themselves may be shaped to adequately conform to the contour of the human body.

2. Description of the Prior Art

Numerous innovations for cushioning devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

U.S. Pat. No. 4,798,414, issued to Hughes, titled "Physiotherapeutic chair like device"

The patent to Hughes describes a special chair with embodiments providing means for prevention and treatment of back disorders by both static and dynamic operational modes comprising an integral seat and back assembly composed of multiple articulating hard surfaced segments floating on and supported by a plurality of elastic tension cords, some having oval shaped cams attached thereto. The elastic tension cords are suspended in parallel and attached to transverse members which are connected to left and right chair sides all of which are assembled in an arrangement to automatically adjust contoured and proper support to the lower and middle back regions in accordance with the weight and body bulk distribution of the occupant. A motor drive arrangement and cam spool assembly are concealed within the body of the chair to activate the hard surface elongated segments of said integral seat and back assembly in an alternating translatory and articulating motion to result in passive exercise to the lower and middle back muscles and vertebrae of the occupant.

U.S. Pat. No. 5,632,473, issued to Dias Magalhaes Queiroz, titled "Elastic spring and spring support for mattress, chair or upholstery"

In the patent to Queiroz, an elastic framework for a mattress, chair, upholstery, etc. is disclosed which includes elastic springs made of opposing upper and lower elastic elements, each elastic element having a base portion and a plurality of flexible arms which extend from the base portion and are joined to the flexible arms of the opposing upper or lower element so as to form a closed flexible ring. These flexible rings are joined to top support elements and bottom support elements at the base portion of the upper and lower elastic elements, respectively, and the top support elements as well as the bottom supported elements are respectively interconnected so as to form a spring support.

U.S. Pat. No. 4,911,500, issued to Saiger, titled "Spring chair frame and method of fabricating same"

The patent to Saiger describes a spring chair has a seat frame and a base frame including an upper portion fixed to the seat frame, spaced front leg portions extending generally vertically down from said upper portions at the front of the seat portion, and base portions extending horizontally rearwardly from the leg portions to underlie the seat portion. The leg portions and base portions extend from a right angular bend portion and have lengthwisely extending openings. Unitary right angular springs inserted in the openings provide spring resilience to the bend portions which will restore them to normal position. The springs are preinserted in the linear extrusion strip which is bent to the base frame configuration so that extrusion a bending and spring bending occur simultaneously.

U.S. Pat. No. 5,100,201, issued to Becker, III, et. al., titled "Passive ergonomic work chair"

In the patent to Becker, a personal office or work chair is provided which includes an open frame construction wherein a seat portion of the chair includes a pair of front springs mounted on either side of the frame, each spring located between frame members extending rearwardly toward the chair seat back portion of the chair, and forwardly to the front edge of the seat portion. In a preferred arrangement, each spring comprises a strip of non-woven fiberglass epoxy resin including forward and rearward substantially planar mounting portions. At the same time, the seat back portion of the chair includes an open frame wherein a pair of laterally spaced frame members are hingedly secured to the corresponding laterally spaced frame members of the seat portion by a hinge bar or rod extending across the frame. One each side of the frame, there is a relatively rigid but somewhat flexible plastic spring fixedly secured between adjacent seat frame and seat back frame members, overlapping the hinged connection between the seat and seat back frame portions. These relatively rigid plastic springs are generally L-shaped and are fixedly riveted to the seat frame members.

U.S. Pat. No. 5,580,128, issued to Johnson, et. al., titled "Therapeutic seat"

The Johnson invention is an improved seat device to be used by those who have pain or discomfort sitting on a regular seat. The seat device can be attached to a chair frame or be used as a portable unit in the home or while traveling.

U.S. Pat. No. 5,077,849, issued to Farley, titled "Anatomically conformable foam support pad"

The patent to Farley describes a convoluted foam pad for supporting a reclining human body on a bed including an area for supporting the shoulders of a body, an area for supporting the tail portion of a body and a general support area surrounding the shoulder and tail support areas for supporting the remainder of the body. In one embodiment the support area is formed by peaks arranged in rows, wherein each peak has a flat top and is spaced from any adjacent peak in the same row by a valley. The average valley thickness of the valleys in both the shoulder support area and the tail support area are less than the average valley thickness of the valleys in the general support area. In another embodiment, the shoulder and tail support areas are formed by parallel ribs separated and bounded by areas comprising flat-topped peaks and valleys. Another aspect of the invention is a method of manufacturing convoluted foam pads including compressing a foam block between two rollers having radially extended fingers of varying effective heights, cutting the compressed block into halves having varying peak heights and valleys having varying valley floor heights, and cutting the tops of the peaks off the create areas having lower volumes of foam than other areas.

U.S. Pat. No. 4,660,887, issued to Fleming, et. al., titled "Ergonomic support"

In the patent to Fleming, an ergonomic support in the nature of chairs, sofas and the like, includes flexible and resilient posterior and lumbar supporting portions having non-planar, contoured shaped surfaces which comfortably conform to the body. The supporting portion is shaped to form a plurality of cantilevers which automatically adjust and conform to body movement without mechanical parts, as opposed to adjusting the body to conform to the supporting portion.

U.S. Pat. No. 4,502,731, issued to Snider, titled "Seat frame"

The patent to Snider describes a one-piece seat frame structure having a plurality of parallel curvilinear slots which demarcate cantilever-action spring segments. A thin-walled, hollow, molded plastic body, or a similar body of another suitable relatively rigid material having resilient characteristics, has a pair of side walls, a rear wall, a front wall and a positively bowed top. A plurality of parallel curvilinear slots are provided through the top to demarcate a plurality of parallel curvilinear spring segments. In response to a typical load created by a seat occupant, the spring segments are deflected downward in a cantilever manner.

As outlined above, the prior art patents that relate to therapeutic chair and future devices largely entail elements such as: an integral seat and back assembly composed of hard surfaced segments floating on and supported by a plurality of elastic tension cords; elastic springs that form a closed flexible ring; an open frame construction wherein a seat portion of the chair includes a pair of front springs mounted on either side of the frame; a foam pad for supporting a reclining human body on a bed; chairs, sofas and the like which include flexible and resilient posterior and lumbar supporting portions; and a one-piece seat frame structure having a plurality of parallel slots which demarcate cantilever-action spring segments.

In contrast, the present invention utilizes a great number of vertically moving pins in connection with springs, with spherical members at the top thereof functioning to conform to the contour of the user's body. Unlike in the prior art, the pins of the present invention are in close proximity to one another, engaging pressure points and allowing the user to remain on the item with enhanced comfort. Moreover, the device may include a varying quantity of pins, varying length of pins utilized, and varying materials of construction.

SUMMARY OF THE INVENTION

As previously noted, the present invention is a cushioning system for chairs, and other articles of furniture that features a multiple pin and spring assembly for the utmost in user comfort. Specifically, the cushioning apparatus includes a great number of vertically moving pins, with spherical shaped members at a top portion thereof, that receive the weight of the user and function to fit the contour of the user's body. In the preferred mode, wood spherical members upon stainless steel pins are in close proximity to one another, to engage all relevant pressure points of the body and allow the user to remain on the furniture item for extended periods without discomfort.

With the foregoing in mind, one feature taught by the present invention is that the device may include a varying quantity of pins.

Another feature of the present invention is that a varying length of pins may be utilized.

Another feature of the present invention is that varying materials of construction may be utilized.

Another feature of the present invention is that the device may also be designed in an aesthetically pleasing manner, with pins and spherical heads colored in such a fashion as to create desired images upon the future item.

Still another feature of the present invention is that the device allows for the frame of the future item to be simpler in nature and easier to manufacture, as the pins themselves may be shaped to adequately conform to the contour of the human body.

Another feature of the present invention is that the spherical members may be filled with liquid.

An additional feature of the present invention is that such spherical members may be heated to provide further comfort to the user in a therapeutic manner.

Another feature of the present invention is that the device may further utilize a mechanical massage means to provide the utmost in user comfort.

With regards to the versatility of the invention, the device may be utilized in combination with articles of furniture such as chairs, beds, daybeds, couches, sofas, loveseats, lounges, stools, ottomans, and benches.

Lastly, it should be noted that the device may be retrofitted to previously existing articles of furniture, allowing for all persons to benefit from its unique therapeutic design.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
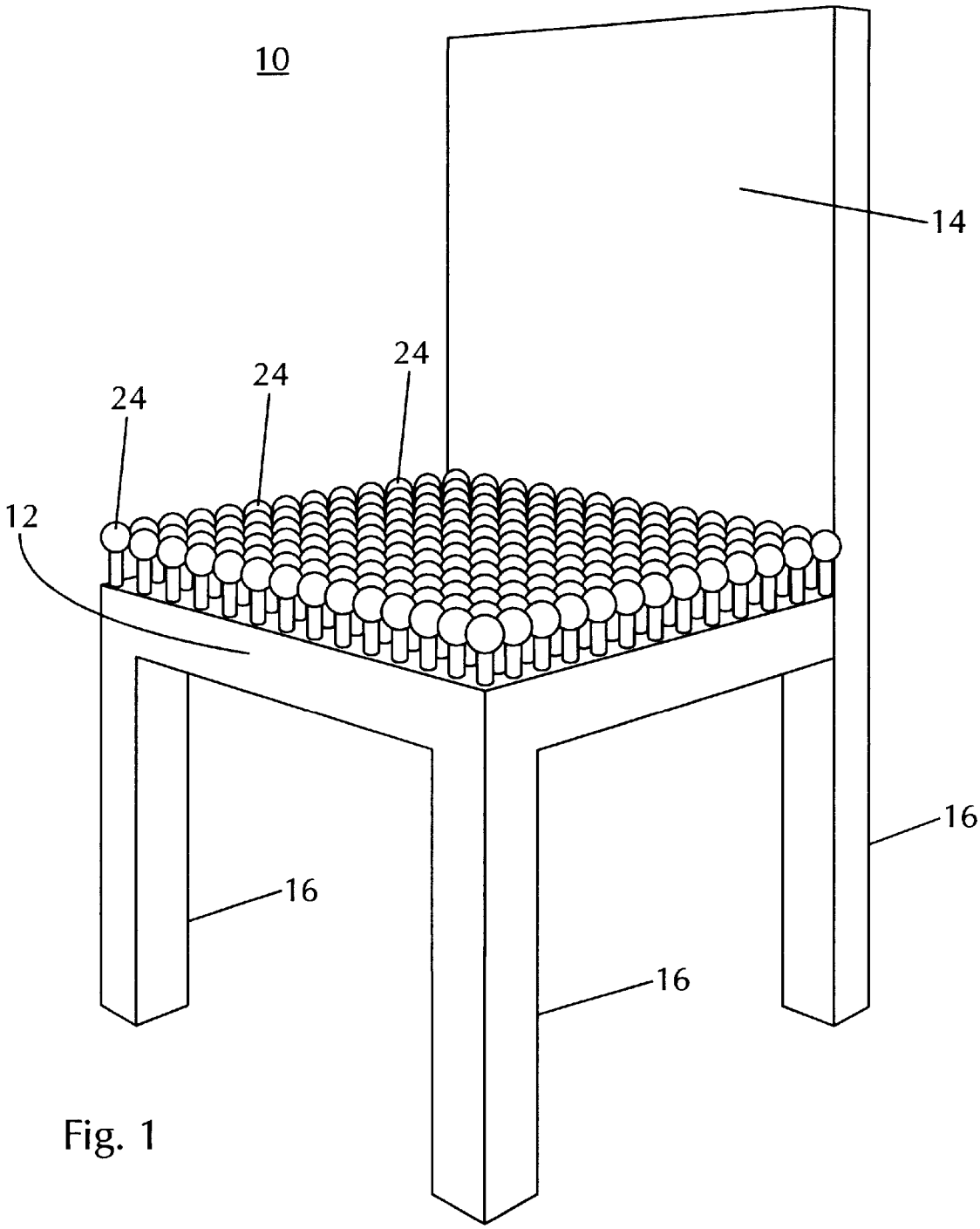
FIG 1 is a three-quarter perspective view of a standard chair in combination with the therapeutic cushion device of the present invention, illustrated for the purposes of example.

Firstly, referring to FIG. 1, which is a three-quarter perspective view of a standard chair in combination with the therapeutic cushion device of the present invention, illustrated for the purposes of example: The therapeutic cushion device (10) is used in combination with an article of furniture to achieve comfort for a user. Although particularly suitable for usage in combination with a standard chair of a computer work station, the present invention may be adapted to many styles of seats and furniture. The device comprises a seat portion (12) comprising a plurality of vertically moving pins (18) in close proximity to one another with base portions (20) holding same in place. Each pin (18) comprises a spherical member (24) at a top portion thereof, the spherical members (24) receiving the weight of the user and functioning to adapt to the contour of the user's body.

As shown, the therapeutic cushion device (10) further comprises a back portion (14) and a plurality of legs (16).

Figure 2:
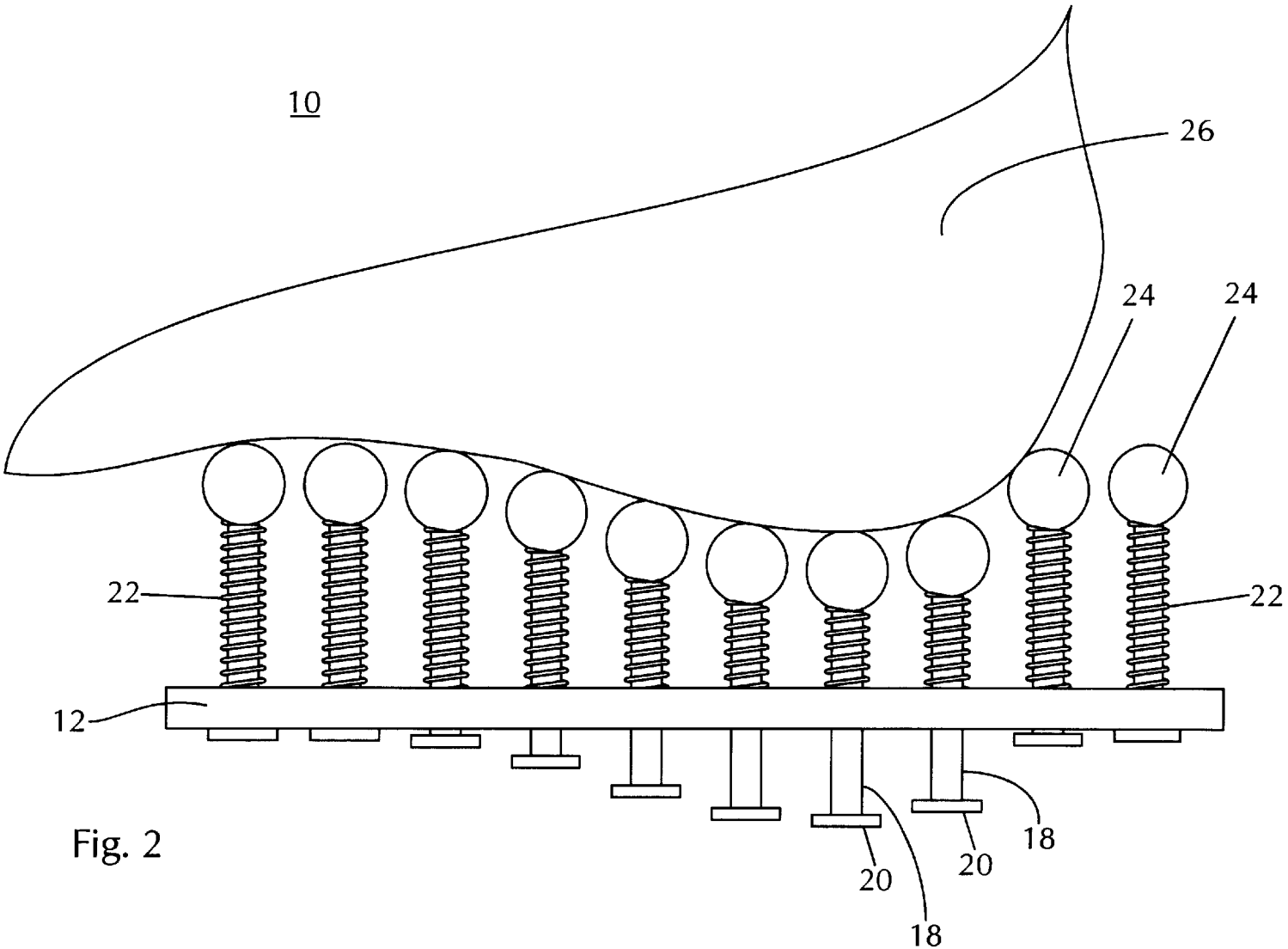
FIG. 2 is a side perspective view of a user upon the therapeutic cushion device, depressing a plurality of cylindrical rods of same to tightly engage the contour of the user's body.
Figure 3:
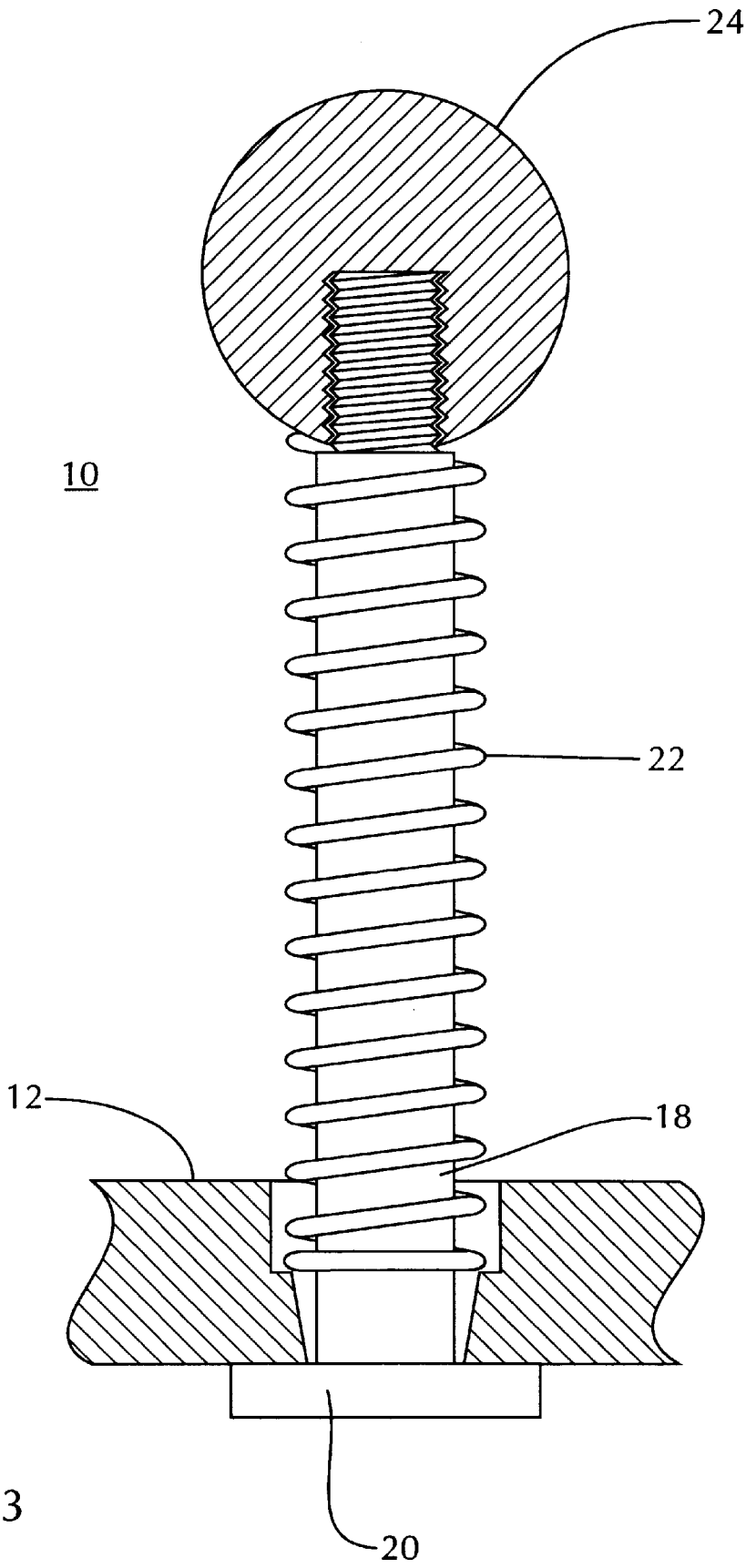
FIG. 3 is a cross-sectional view of a cylindrical rod assembly of the present invention, illustrating base portion, spring means, spherical member, and seat portion of same.

Next, referring to FIG. 2, which is a side perspective view of a user upon the therapeutic cushion device, depressing a plurality of cylindrical rods of same to tightly engage the contour of the user's body, and referring to FIG. 3, which is a cross-sectional view of a cylindrical rod assembly of the present invention, illustrating base portion, spring means, spherical member, and seat portion of same:

Vertical movement of the aforementioned pins (18) and spherical members (24) are accomplished through the usage of a spring means (22). This allows the device (10) to provide constant stimulation to the body, functioning to facilitate blood circulation of the user (26) by providing multiple pressure points upon the user (26) by means of full body to surface contact.

In the preferred mode of manufacture, the spherical members (24) are manufactured of a wood material, which is both durable and very comfortable to the user. The comfort of the spherical members (24) themselves are the greatest reason why the device (10) functions to engage a plurality of pressure points of the body, allowing the user (26) to remain on the article of furniture for extended periods without discomfort and numbing of body parts.

Moreover, the pins (18) are manufactured of a stainless steel material in the preferred mode. Such material is chosen based upon strength, durability, and ease of manufacture. It is important to note that a varying quantity of such pins (18) may be utilized, and that the length of the pins (18) may vary as well. Such variables will allow the manufacturer to produce the article of furniture in combination with the present invention (10) to accommodate all persons, regardless of their size and inherent shape. In addition, the spring means (22) utilized by the steel pins (18) may itself vary in strength and may be adjusted by the manufacturer or user (26). Thus, an assembly featuring a spring means (22) of greater tension may be utilized for articles produced for larger, heavier persons (26).

In an alternate mode of manufacture, the back portion (14) of the article of furniture may also comprise multiple moving pins (18) in substantially close proximity to one another. Similarly to the construction above-described, each pin (18) comprises a spherical member (24) at a top portion thereof, the spherical members (24) functioning to receive the weight of the user (26) and further functioning to adapt to the contour of the user's body. Again, movement of the pins (18) and spherical members (24) are accomplished through the usage of a spring means (22).

In another alternate mode of manufacture, the device (10) may be designed in an aesthetically pleasing manner by utilizing the large number of spherical members (24) in an artistic fashion. In such an instance, the pins (18) and spherical members (24) may be colored in such a manner as to create previously determined images upon the article of furniture, including images suitable for and recognized by children. Such can be expected to increase the overall appeal of the present invention (10), while further distinguishing such from devices of the prior art.

In still further alternate modes of production, the spherical members (24) of the present invention (10) may be filled with liquid, and such may be heated for increased therapeutic value. Moreover, the device (10) may further utilize a mechanical massage means that also functions to provide comfort to the user (26) who may seated on the article of furniture for many hours.

With regards to all FIGURES, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention. Specifically, the device may be utilized in combination with articles of furniture such as chairs, beds, daybeds, couches, sofas, loveseats, lounges, stools, ottomans, and benches. Further, the device may be retrofitted to previously existing articles of furniture, allowing for all persons to benefit from its unique therapeutic design.

Without further analysis, the foregoing will so filly reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

Reference numerals in drawings

10—therapeutic cushion device
12—seat portion
14—back portion
16—leg portion
18—pins
20—pins base portion
22—spring means
24—spherical members
26—user

What is claimed is:

1. A therapeutic cushion device used in combination with an article of furniture to achieve comfort for a user, the device comprising:

a seat portion comprising a plurality of vertically moving steel pins in substantially close proximity to one another, the position of the seat portion may be adjustable, each pin comprising a wooden spherical member at a top portion thereof, the spherical members functioning to receive the weight of the user and further functioning to adapt to the contour of the user's body, vertical movement of the pins and spherical members accomplished through the usage of a spring means, tension of the spring means may be adjustable, said seat portion used in conjunction with a back portion and a plurality of legs, the position of the back portion may be adjustable, allowing the device to provide constant stimulation to the body, functioning to facilitate blood circulation of the user by providing multiple pressure points upon the user by means of fall body to surface contact, further allowing the device to engage a plurality of pressure points of the body, allowing the user to remain on the article of furniture for extended periods absent discomfort and numbing of body parts, thus allowing the device to be effective for use in connection with a chair for usage in a computer work station.

2. The therapeutic cushion device as described in claim 1, wherein a varying quantity of pins may be utilized.

3. The therapeutic cushion device as described in claim 1, wherein varying sizes of spherical members may be utilized.

4. The therapeutic cushion device as described in claim 1, wherein pins of a varying length may be utilized.

5. The therapeutic cushion device as described in claim 1, wherein the device is designed in an aesthetically pleasing manner.

* * * * *